US005078164A

United States Patent [19]

Doellgast

[11] Patent Number: 5,078,164

[45] Date of Patent: Jan. 7, 1992

[54] MICROTITER PLATE WASHER

[75] Inventor: George J. Doellgast, Winston-Salem, N.C.

[73] Assignee: Elcatech, Inc., Salem, N.C.

[21] Appl. No.: 235,232

[22] Filed: Aug. 23, 1988

[51] Int. Cl.[5] ..... B08B 3/02

[52] U.S. Cl. ..... 134/166 R; 134/169 R; 134/171; 134/102; 422/303

[58] Field of Search ..... 134/102, 166 R, 168 R, 134/198, 167 R, 171, 169 R; 422/300, 303; 239/397, 556

[56] References Cited

U.S. PATENT DOCUMENTS

| | | | |
|---|---|---|---|
| 1,400,797 | 12/1921 | Burnham | 134/167 R |
| 1,983,390 | 12/1934 | Mueller . | |
| 2,029,844 | 2/1936 | Tyler . | |
| 2,141,516 | 12/1938 | Clements . | |
| 2,381,436 | 8/1945 | Cozzoli . | |
| 2,546,385 | 3/1951 | Christina . | |
| 2,786,479 | 3/1957 | Dungfelder et al. | 134/171 X |
| 2,786,480 | 3/1957 | Hofer | 134/171 |
| 2,827,063 | 3/1958 | Roy | 134/171 |
| 2,970,700 | 2/1961 | Lacy et al. | 134/171 X |
| 3,070,104 | 12/1962 | Faust et al. | 134/171 X |
| 3,879,795 | 4/1975 | Gfeller | 134/171 X |
| 4,559,664 | 12/1985 | Bohme et al. | 134/171 X |
| 4,641,674 | 2/1987 | Batjer et al. | 134/171 X |
| 4,708,153 | 11/1987 | Hambleton et al. | 134/166 R X |

*Primary Examiner*—Frankie L. Stinson
*Attorney, Agent, or Firm*—Cooley Godward Castro Huddleson & Tatum

[57] ABSTRACT

A microtiter plate washer comprising multiple upward-directed nozzles, each nozzle comprising a body member with an internal cavity and an orifice; fluid distribution means capable of connecting an external reservoir of liquid or gas to the internal cavity of the nozzles; and clamping means for engaging the nozzles to the fluid distribution means.

14 Claims, 9 Drawing Sheets

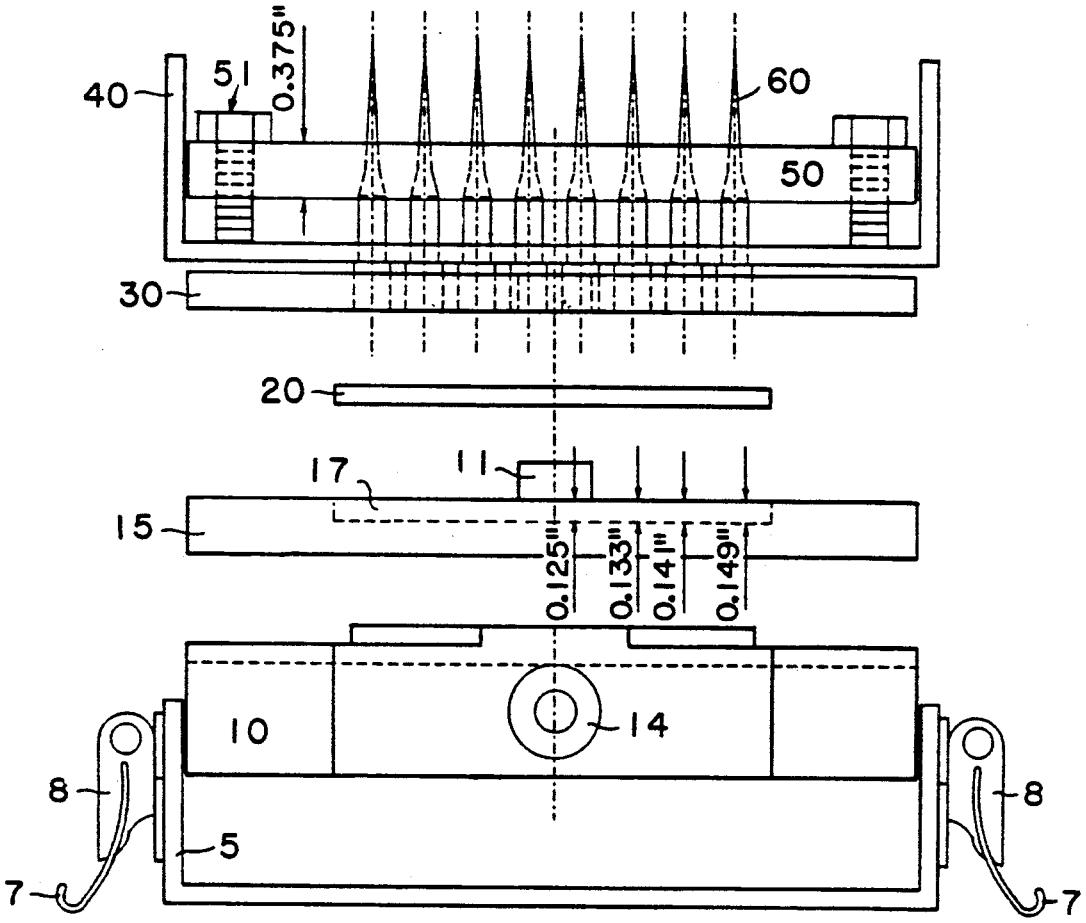
FIG. 8
FIG. 9
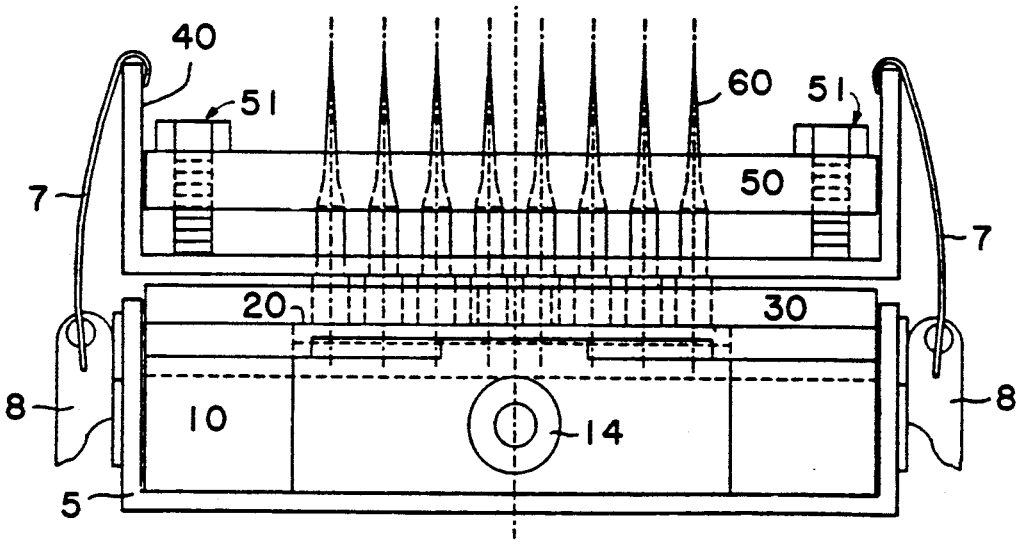

MICROTITER PLATE WASHER

FIELD OF THE INVENTION

This invention relates to automated equipment for manipulating microtiter plates and particularly to equipment for washing microtiter plates.

BACKGROUND OF THE INVENTION

A number of laboratory operations require the handling of multiple small samples. For example, immunoassays can be carried out in volumes of 100 μl or less while involving a number of manipulations, such as adding and removing of reagents and carrying out serial dilutions of samples. In order to handle multiple small samples, including related samples such as are present in a serial dilution, a type of reaction vessel known as a microtiter plate has been developed. Such plates are typically made of polypropylene or a similar plastic and have a number of wells arranged in a geometric pattern that simplifies organizing and carrying out related operations. A commonly used plate is about 5×3.5 inches and contains 96 wells in an 8×12 rectangular pattern, each well having a total capacity of 1 ml or less. Other microtiter plates are available with different numbers of wells and capacities.

Recently, automatic or semi-automatic equipment has been developed to carry out a number of operations. For example, equipment is available to automatically add reagents, serially dilute samples, and optically read results of analyses carried out in microtiter plates.

An additional operation that has been automated is the washing of microtiter plates. A number of reactions require removal of excess reagent at various stages of the reaction. For example, immunological assays are carried out in which a reagent, such as an antibody that specifically binds to an analyte, is attached to the walls of the microtiter plate wells. In a typical assay, a sample is added, and analyte, if present, binds to the antibody. A color-forming reagent is next added, and, if the analyte was present in the sample, a color forms in the well. Reagents must be washed out of the wells in order to prevent color from forming in wells to which no analyte was added. Microtiter plate washers have been developed to automatically carry out the washing operation. Typical of these is a device produced by Bio-Rad Laboratories of Richmond, Calif. The microtiter plate resides in its upright position in a holder which moves it to the proper location. A series of downward directed needle-like nozzles add wash solution to each well in a plate (or a row of wells in a plate), followed by removal of the wash liquid by aspiration using a different set of needle-like nozzles inserted downward into the wells. Other washers of similar design are manufactured and/or marketed by Tri-Continent Scientific, Grass Valley, Calif.; Dynatech Laboratories, Inc., Chantilly, Va.; Skatron AS, Lier, Norway; SLT-Labinstruments, Groeding, Austria; Tomtec, Orange, Conn.; and Flow Laboratories, Inc., McLean, Va.

Although such equipment is efficient in carrying out the washing operation, the equipment is complicated and costly. Careful design must occur if the aspirating pipettes are to remove the maximum amount of liquid for efficient washing without disturbing reagents attached to the walls of the microtiter plate.

Simplified equipment is available for washing individual items, such as cuvettes, using an upward-directed spray. However, such devices typically use vacuum to pull wash liquid into the cuvette and then withdraw the washing liquid. Vacuum is not appropriate for a relatively large flat object such as a microtiter plate, since the resulting relatively large force (from the vacuum acting on the large area of the plate) would make manipulation of the microtiter plate difficult.

Accordingly, simplified equipment of lower cost and few design constraints is desirable.

SUMMARY OF THE INVENTION

The present invention provides a microtiter plate washer comprising multiple upward-directed nozzles, each nozzle comprising a body member with an internal cavity and an orifice leading from the cavity to the exterior of the nozzle; a fluid distribution member having a fluid inlet and multiple fluid outlets, for distributing wash liquids to each nozzle; and clamping means for releasably sealing said nozzles to said fluid distribution member. A fluid conduit capable of connecting an external reservoir to the internal cavity of each of said nozzles by means of the distribution system is also provided, wherein the conduit has a minimum cross-sectional area larger than the total orifice area of all nozzles. Since the invention can be used with standard disposable pipette tips as nozzles, the invention also comprises the clamping means and fluid distribution member as set forth herein in the absence of the nozzles. The clamping means is specifically designed to space an array of nozzles such that they are capable of washing at one time either an entire microtiter plate or a row of a microtiter plate. In operation, a microtiter plate is washed in an upside down position with a device of the invention.

The invention also encompasses the method used with the device as described herein, including washing a multiple number of microtiter plate wells with an upward-directed stream of wash solution through multiple nozzles.

BRIEF DESCRIPTION OF THE DRAWINGS

The present invention will be better understood by reference to the following detailed description of specific embodiments when considered in combination with the drawings that form part of this specification, wherein:

FIG. 8 is an exploded, end view of a preferred embodiment of the invention.

FIG. 9 is an end view of the embodiment of FIG. 8 in assembled form.

DESCRIPTION OF SPECIFIC EMBODIMENTS

The microtiter plate washer of the present invention, by directing the washing stream upward, allows rapid washing of multiple microtiter plates. A pressure-driven fluid stream (typically gravity-driven or compressed-gas-driven) is used to avoid problems arising from the use of vacuum on large surfaces, as described above. The washer is typically prepared from either disposable or autoclavable materials so that the washer can be decontaminated if necessary after use. Many of the advantages of the washer can be seen by reference to the Figures and the following detailed description.

Figure 1:
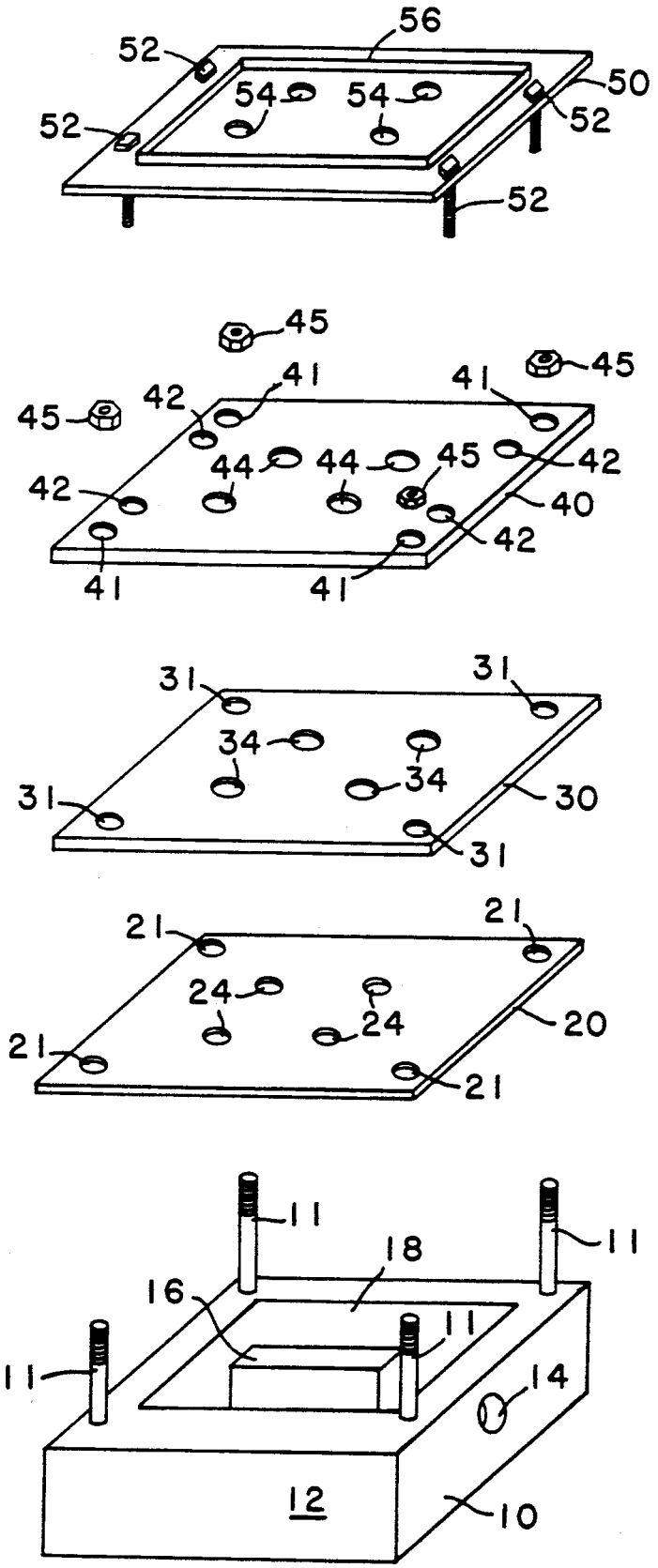
FIG. 1 is an exploded perspective view of a first embodiment of the invention shown without nozzles.

FIG. 1 is an expanded perspective view of a first embodiment of the invention showing one manner of providing the required elements. FIG. 1 (as well as FIGS. 4–6, which show cross-sectional views) shows a 2×2 plate washer with four nozzles for simplicity. Similar designs are applicable for use with larger plate washers such as those having 4×6, 6×8, or 8×12 arrays of nozzles. Distribution box 10 comprises container walls 12 with inlet 14 in one container wall. The interior of distribution box 10 contains a series of ridges 16 and channels 18 spaced to provide support for later-described parts of the apparatus that will rest on the ridges. Channels 18 are spaced so as to allow fluid entering through aperture 14 to be distributed to each of the nozzles when they are in place in the apparatus. In this first embodiment, four pins (11) are provided at the corners of distribution box 10 to properly register upper members to the lower distribution box. The pins may be provided with threads to allow upper members to be pressure fitted to the top of distribution box 10 or other means can be provided for holding the apparatus together.

A resilient sealing member is next provided to fit over ridges 16 and channels 18. As shown in FIG. 1, registration apertures 21 are provided at each corner of sealing member 20 to fit sealing member 20 on the upper surface of distribution box 10 and to provide the proper spacing so that apertures 24, which provide access to nozzles that will rest on the sealing member, properly register with channels 18 for distribution of fluid. In this embodiment, the resilient sealing member must be sufficiently rigid to provide support for the nozzles since channels 18 have open tops and do not provide support on all sides of fluid distribution apertures 24. Apertures 24 are arranged in an array to match the wells of the microtiter plate, as will be apparent from the following description.

In the embodiment shown, positioning member 30 forms the next layer of the apparatus. Positioning member 30 has a registration aperture 31 at each corner, each of which fits over corresponding post 11 of distribution box 10. A series of apertures 34 are provided which register with apertures 24 of sealing member 20. Apertures 34 of positioning member 30 are larger than corresponding apertures 24 of sealing member 20 and are arranged concentrically therewith. This allows fluid to be distributed through sealing member 20 into the central portion of a hollow nozzle placed in each of the apertures 34 of positioning plate 30. Use of positioning plate 30 to properly position nozzles is shown in and discussed in more detail in the discussion of FIG. 2.

Clamping plate 40 is also provided with registration apertures 41 at its corners and nozzle apertures 44 which fit over the nozzles and are aligned by the interaction of pins 11 and positioning holes 41 concentrically over corresponding apertures 24 and 34 of sealing member 20 and positioning plate 30 as described above. Apertures 44 are smaller than the lower portion of the nozzle that will reside in positioning aperture 34 of plate 30 so that clamping plate 40, when positively urged in the direction of distribution box 10, clamps nozzles firmly against sealing member 20. This clamping relationship is also shown and discussed below in relation to FIG. 2.

In the embodiment of FIG. 1, a series of four nuts 45 capable of engaging threads on posts 11 are provided for urging clamping plate 44 and the nozzles being sealed against sealing member 20 in the direction of distribution box 10. Other means for urging the clamping plate can be provided if desired, and variations are shown in later Figures and are discussed below.

A microtiter plate positioning member (plate) 50 can be provided as shown in FIG. 1. Ridges 56 or other means for properly locating a microtiter plate on the positioning member can be provided. Apertures 54 are located directly above corresponding clamping apertures 44 and the nozzles clamped therein. If desired, the nozzles can extend through plate 50 and apertures 54 therein or positioning plate 50 can be located entirely above the nozzles. In the embodiment shown in FIG. 1, a series of four bolts 52 are rotatably engaged by threaded apertures at the corners of plate 50 so that plate 50 can be positioned at varying heights above clamping plate 40. Bolts 52 engage the threads of aligning apertures 42 in clamping plate 40 and can be rotated to affix plate 50 to plate 40 at the preset height of the bolt.

Figure 2:
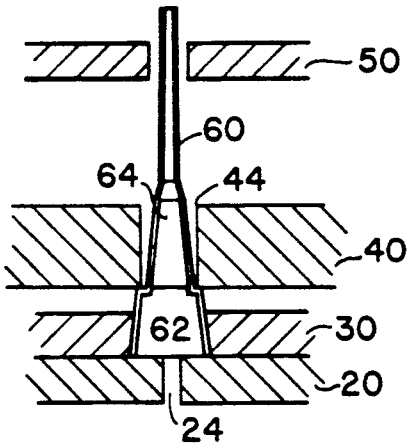
FIG. 2 is a vertical cross-sectional view showing in detail a single nozzle clamped in the device of FIG. 1.

Details of the nozzle clamping arrangement are shown in FIG. 2, which is a cross-sectional view of a small section of the microtiter plate washer showing a single nozzle in position. Nozzle 60 comprises a lower portion 62 and an upper portion 64 with upper portion 64 being sized to pass through aperture 44 of clamping plate 40 while clamping plate 40 at the edges of aperture 44 engage lower portion 62 of the nozzle. Clamping aperture 44 is sized so that upper portion 64 of nozzle 60 does not engage aperture 44 so snugly that the nozzle would be retained in the aperture when clamping plate 40 is raised. As shown in FIG. 2, clamping plate 40 engages nozzle 60 at a height sufficiently above sealing means 20 to prevent clamping plate 40 from contacting positioning plate 30 before lower portion 62 of nozzle 60 is urged against sealing member 20 at aperture 24.

A number of variations on the embodiment shown in FIGS. 1 and 2 are possible. For example, members 20 and 30 can be combined to a single sealing member/positioning plate. Alternatively, an additional plate can be provided similar to clamping plate 40 but located between sealing member 20 and distribution box 10 to provide support to the sealing member. Such a support member is particularly useful if a highly flexible sealing member is used. On the other hand, if the sealing member is sufficiently resilient to provide a good seal and has sufficient strength to resist the downward force of the clamping plate, an apparatus as shown in FIG. 2 or an apparatus using a combined positioning plate and resilient member prepared as a unit can be used.

FIG. 3 provides a series of sectional views of small sections of the apparatus of the invention, each sectional view showing a different variation of one or more parts of the apparatus.

Part A of FIG. 3 shows a device with a unitary sealing means/positioning plate 25 replacing sealing means 20 and plate 30 of FIG. 1. A unitary clamping plate/microtiter plate positioner 35 is also provided to replace separate clamping plate 40 and positioning plate 50 of the embodiment shown in FIG. 1. Member 25 rests on ridges 16 of distribution box 10 so that channel 18 is positioned directly beneath nozzle 60.

Part B of FIG. 3 shows distribution box 10 with interior channels 18 but which provides an aperture 19 centered under nozzle 60 to replace long, open channels 18 as shown in FIG. 1. Accordingly, the upper face of distribution box 10 serves to support resilient member 20 without requiring internal support. Positioning member 30 is present as in FIG. 1, but nozzle 60 now has a lower portion 62 which does not exceed the height of member 30. Accordingly, a downward projecting lip 46 is provided around aperture 44 of clamping member 40 to urge nozzle 60 against resilient member 20 before clamping plate 40 contacts positioning plate 30. A microtiter plate positioning plate 50 is provided as in FIG. 1.

Part C of FIG. 3 shows an embodiment using a different clamping and positioning arrangement. A positioning post 100 is provided in base 10 in a manner similar to post 11 of FIG. 1. However, positioning post 100 engages only resilient member 20 and positioning plate 30. A separate post 110 threadably engages a threaded hole 120 in base 10. An engaging portion 145 of post 110 engages clamping plate 40 and urges clamping plate 40 in the direction of base 10 when threads 112 of post 110 engage threads 114 of hole 120 and post 110 is rotated in a first direction. Rotating in the opposite direction releases the clamping force. Positioning pin 480 is provided in plate 40 to properly locate microtiter plate positioning member 50 when pin 480 is inserted into recess 580 in the lower surface of positioning member 50.

Part D of FIG. 3 shows a spring-loaded clamping arrangement comprising a bar 110 rotatable in a vertical plane about pin 122 located in one end of bar 110 and in recess 120 located in base member 10. Spring 148 provides the downward force on clamping plate 40 by pressing upward on spring retainer 145 and downward on spring retainer 146 which is provided with projection 147 for ease of manipulation. When clamping plate 40 is to be engaged, bar 110 is moved from its resting horizontal position (as indicated by the arrow in FIG. 3D) while compressing spring 48 using an upward-directed force on projection 147 of lower spring retainer 146. When bar 110 is rotated into position so that bar 110 engages a corresponding slot 48 of clamping plate 40, the upward force on lower spring retainer 146 is released so that spring 148 engages clamping plate 40 by means of lower spring retainer 146 and urges clamping plate 40 and its retained nozzles in the direction of base 10 and sealing member 20.

Figure 3A:
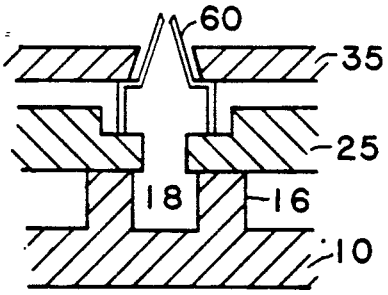
FIGS. 3A–D provide a series of vertical cross-sectional views of variations on the device of FIG. 1.
Figure 3B:
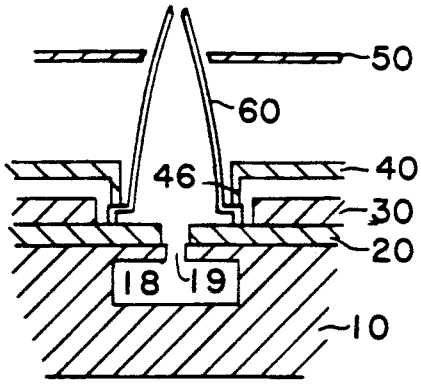
Figure 3C:
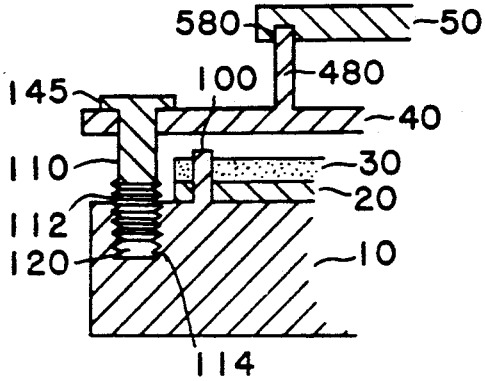
Figure 3D:
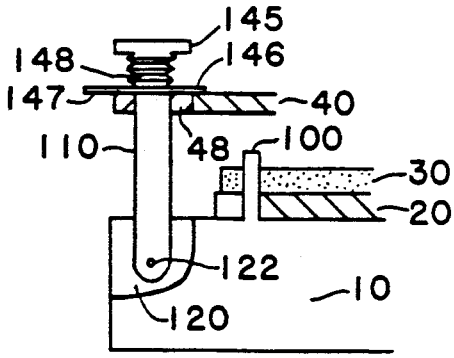
Figure 4:
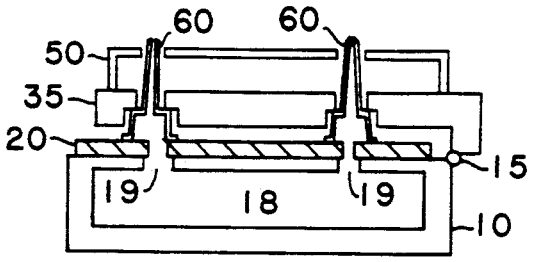
FIG. 4 is a vertical cross-sectional view of a further embodiment of the invention in the clamped position showing multiple nozzles in position for washing.

FIG. 4 shows another embodiment of the invention in which all of the members other than the nozzles are permanently or temporarily joined together by a hinge at one side of the apparatus for ease of manipulation. Sealing member 20 is permanently or temporarily affixed to an upper surface of distribution box 10, which contains an internal cavity 18 with apertures 19 in its upper face in proper register with apertures 24 of sealing member 20. Hinge 15 is provided at one side of base 10 to connect the base member to the remainder of the apparatus. A combination positioning member and clamping member 35 is provided. A microtiter plate positioning member 50 is provided as in FIG. 1 affixed to member 35. The form of member 35 is discussed in more detail below along with the operation of this embodiment of the device. The part of the apparatus that provides the downward force to seal the base of the nozzles 60 to sealing member 20 is not shown in this view of the apparatus, but a spring-loaded urging means as shown in FIG. 3D or a similar fast-acting urging means would be particularly useful for this embodiment of the invention.

Figure 5:
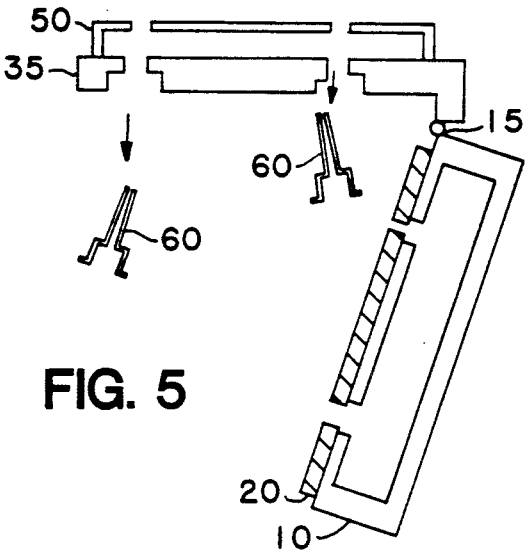
FIG. 5 is a vertical cross-sectional view of the embodiment of FIG. 4 shown in the open position for removal of disposable nozzles.
Figure 6:
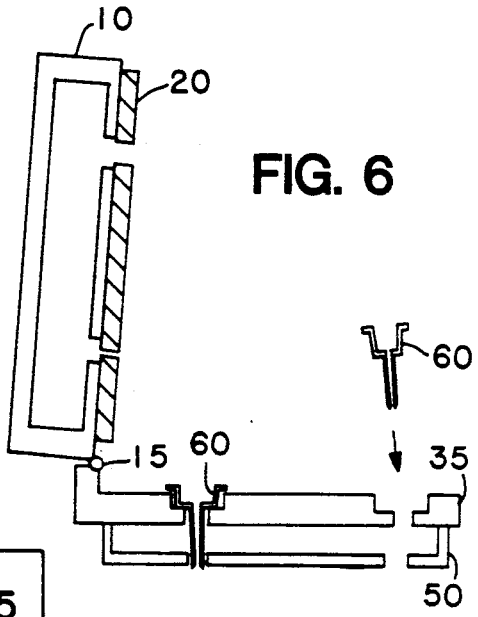
FIG. 6 is a vertical cross-sectional view of the embodiment of FIG. 4 shown in the open position for insertion of disposable nozzles.

FIG. 5 shows distribution base 10 and its attached sealing member 20 rotated to a vertical position while maintaining the upper portion of the apparatus in a horizontal position. Since nozzles 60 are only loosely held in place by the clamping plate, they fall out and can be discarded. Distribution box 10 can then be rotated to its original position and the upper portion of the apparatus rotated to the inverted horizontal position as shown in FIG. 6. Positioning member/clamping plate 35 is provided with a stepped aperture that allows nozzles with a large base section to be easily inserted into member 35, either manually or automatically. Distribution base 10 is then rotated clockwise from the position shown in FIG. 6 while maintaining member 35 in the position shown to prevent the nozzles from falling out of position. After the clamping means is engaged, the apparatus can be placed in the normal position for operation.

The embodiment shown in FIGS. 4–6 is particularly useful for ease of operation and can be automated if desired for use with disposable nozzles.

In addition to the distribution box, nozzles, and the like shown in the previous Figures, an apparatus of the invention will be connected to a fluid distribution system typically comprising a reservoir, a conduit connecting the reservoir to the distribution base, and a valve controlling flow of liquid from the reservoir to the distribution box. A typical apparatus is shown schematically in FIG. 7, in which flow of liquid in reservoir 70 is controlled by valve 80 as it flows through conduit 90 to distribution box 10. The pressure differential necessary for fluid flow can be provided either by gravitational potential (i.e., locating reservoir 70 at a level higher than distribution box 10), by an optional compressed gas reservoir 75 connected to reservoir 70, by a pump (not shown), or by any other means of providing the necessary pressure differential to drive liquid from reservoir 70 to distribution base 10.

There are relatively few design constraints on the reservoir, valve, and conduit. The total cross-sectional area of the conduit (or any other part of the fluid path, such as within fluid distribution base 10) should be greater than the total cross-sectional area of the nozzles in order to provide the proper spray operation at the nozzle tips. The force and shape of the spray are determined by the pressure differential, the cross-sectional diameter of the connecting tube, and the total cross-sectional diameter of the pipettes, as well as design characteristics of nozzles known to those skilled in the art of designing spray nozzles. Complicated spray nozzles are not required for use with the invention, however, since commercially available disposable pipette tips can be used as nozzles. For example, pipette tips used with Beckman or Eppendorf automatic micropipettes can be used in a device of the invention. Beckman tips designed for use in the Biomek robot are particularly useful, as they have a ridge that conveniently accomodates a clamping plate and allows quick release. Any other commercial tip that allows easy clamping by a clamping plate can readily be used, with modifications of the size of apertures in the various plates and the distances between plates being made as necessary to accomodate any given type of tip.

In a typical pipette washer using disposable pipette tips as nozzles, the reservoir can be located from 18–36 inches above the washer, the cross-sectional area of the conduit (connecting tube) can be about 1.25 $cm^2$, and the total cross-sectional area of the pipette tips (96 pipettes) is about 0.2 $cm^2$.

In a variation of the apparatus not shown in the Figures, a disposable sheet holding an array of nozzles can be used to load nozzles into the apparatus. Alternatively, the disposable sheet can replace positioning plate 30 by being provided in the form of a sheet with apertures approximately the size of apertures 44 in clamping plate 40 so that the nozzles are retained in the disposable sheet by the larger base portion of the nozzle. Clamping plate 40 then contacts the disposable sheet which forces the base of the nozzles against sealing member 20. Such a plate could readily be used with the apparatus of FIG. 6 by dropping the entire assembled disposable sheet with inserted nozzles into clamping plate 35 (which would not then require a stepped aperture) while clamping plate 35 is in the inverted horizontal position shown in FIG. 6.

Figure 7:
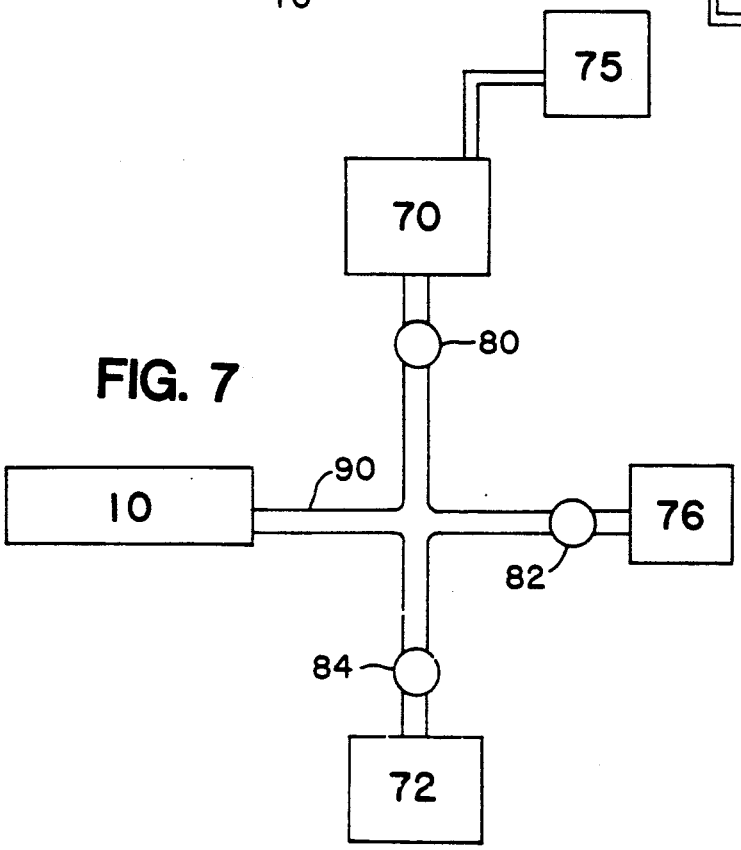
FIG. 7 is a schematic diagram showing fluid connection paths for an embodiment of the invention.

The use of the device has been described already in conjunction with the previous Figures. One method of modifying the method of use uses a compressed gas supply 76 (no compressed gas supply 75 being required) and second control valve 82 as shown in FIG. 7. By alternating between open valve 80 and closed valve 82, followed by open valve 82 and closed valve 80, efficient washing is obtained with less liquid. Solenoid-controlled valves can be provided for valves 80 and 82 with a two-position toggle switch selecting an 80-open/82-closed or 82-open/80-closed position. Toggling between the two positions provides efficient, rapid washing of the plate.

Additionally, further wash solutions can be provided with other solenoid-controlled valves or valves of other types. For example, optional reservoir 72 and control valve 84 of FIG. 7 can be provided to allow washing with a second liquid. The liquid of reservoir 72 can flow under gravitational pressure or as a result of being connected with a compressed gas reservoir (not shown), as for reservoir 70 discussed above. As many control valves as would be needed for the particular operation could be connected into the distribution member, and a microprocessor-controlled timer or other means would automatically channel the appropriate solution into the washer for a length of time specified by the user, with intermittent air, nitrogen, or other gaseous flushes as needed. When a gas flush cycle is used, less pressure on the liquid or less height of the liquid reservoir is needed, since the force of the compressed gas on liquid retained in conduit 90, distribution box 10, and the nozzles can provide the force for washing the microtiter plates.

The apparatus of the invention can be prepared from any material capable of meeting the design characteristics set forth herein. Actual apparatuses have been built using steel clamping plates, rubber sealing members, nylon distribution boxes, and various nylon parts such as positioning plates, screws, and the like. For use with microtiter plates in which blood analyses are carried out, the materials should be selected to withstand autoclaving. Additionally, in situations where human serum or plasma is being tested, any aerosol created during the washing process would need to be contained in order to provide for safety of workers in the vicinity, although capture of the aerosol would not be essential for operation of the apparatus. In cases where a potential exists for contamination with infectious agents, such aerosols should be retained within a chamber surrounding the washing apparatus that would be maintained under negative pressure in order to collect the aerosol. The wash solution should also be collected into a disinfectant.

Additional details of the invention can be seen in FIGS. 8–15 and the following detailed description of a particularly preferred embodiment of the invention. FIG. 8 shows an end view of this embodiment, in which solid lines show visible features and dashed lines show internal features not visible from the end. Combination dashed/dotted lines are used to show axes of alignment (e.g., of nozzles and various apertures). The bottom distribution plate 10 is combined with a second plate 15 (used to support the sealing member 20) containing 0.125-inch (⅛-inch) positioning holes located over the flow channel. The two plates are glued together with epoxy, which fills the outside channel in plate 10 (not shown in this Figure; channel 19 in FIG. 10) designed for this purpose. The holes in the top plate are located in a recess 17 that allows the placement of a silicone rubber gasket 20 having 0.125-inch-diameter holes in the same relative location as the positioning holes. The height of the recess for the positioning holes is variable, being shallower in the middle than on the sides adjacent the clamps (described later) that urge clamping plate 40 in the direction of base 10. For the center two rows, the recess is 0.125 inch. For the next two rows outward, the recess is 0.133 inch; for the next two, 0.141 inch; at the extreme ends, 0.149 inch. This layered recessing accomodates the slight distortion of the plates that occurs during clamping, resulting in a more nearly uniform pressure on the tip bases.

The support plate 15 further includes two 0.50-inch diameter posts 11 that serve as a register for locating positioning plate 30 so that all of the tip bases are located over the positioning holes. Positioning plate 30 has 0.297-inch (19/64-inch) holes for the tip bases and two register holes 0.53 inch in diameter at the same relative position as the posts in the support plate. The clamping plate 40 consists of a U-shaped, 11-gauge stainless steel plate that has 0.219-inch (7/32-inch) holes for tip clamping. The hole dimensions of the tip-positioning and clamping plates are specifically designed to accomodate Beckman Biomek pipet tips but can be readily varied to accomodate other types of commercially available (or specifically manufactured) tips. The support plate 15 and gasket 20 would not be varied in using other manufacturer's pipet tips. The top plate 50 for positioning the microtiter plate to be washed is adjusted to the desired height using positioning screws 51.

The entire assembly consists as well of a bottom U-shaped plate 5 having two quick-release toggle clamps on each side consisting of a flexible stainless steel wire 7 which fits over the edge of the top U-shaped clamping plate 40 and a stainless steel toggle lever 8 to pull the wire down into the clamped position. The entire unit is thus uniformly clamped on the sides, which in the U-shaped format results in minimum distortion of the side of the plate and consequently minimum variation in the tension on each of the tips in a given row. Tension can be adjusted by placing thin shim spacers between the bottom of distribution plate 10 and lower U-shaped metal clamp plate 5. When the rapid-release feature is not needed, the unit can be clamped together with stainless steel screws and nuts, taking advantage again of the uniformity of clamping obtained with the U-shaped top plate. The assembled washer of this embodiment is shown in FIG. 9. Entry tube 14 (for wash liquid) is visible in both FIG. 8 and FIG. 9.

Figure 10:
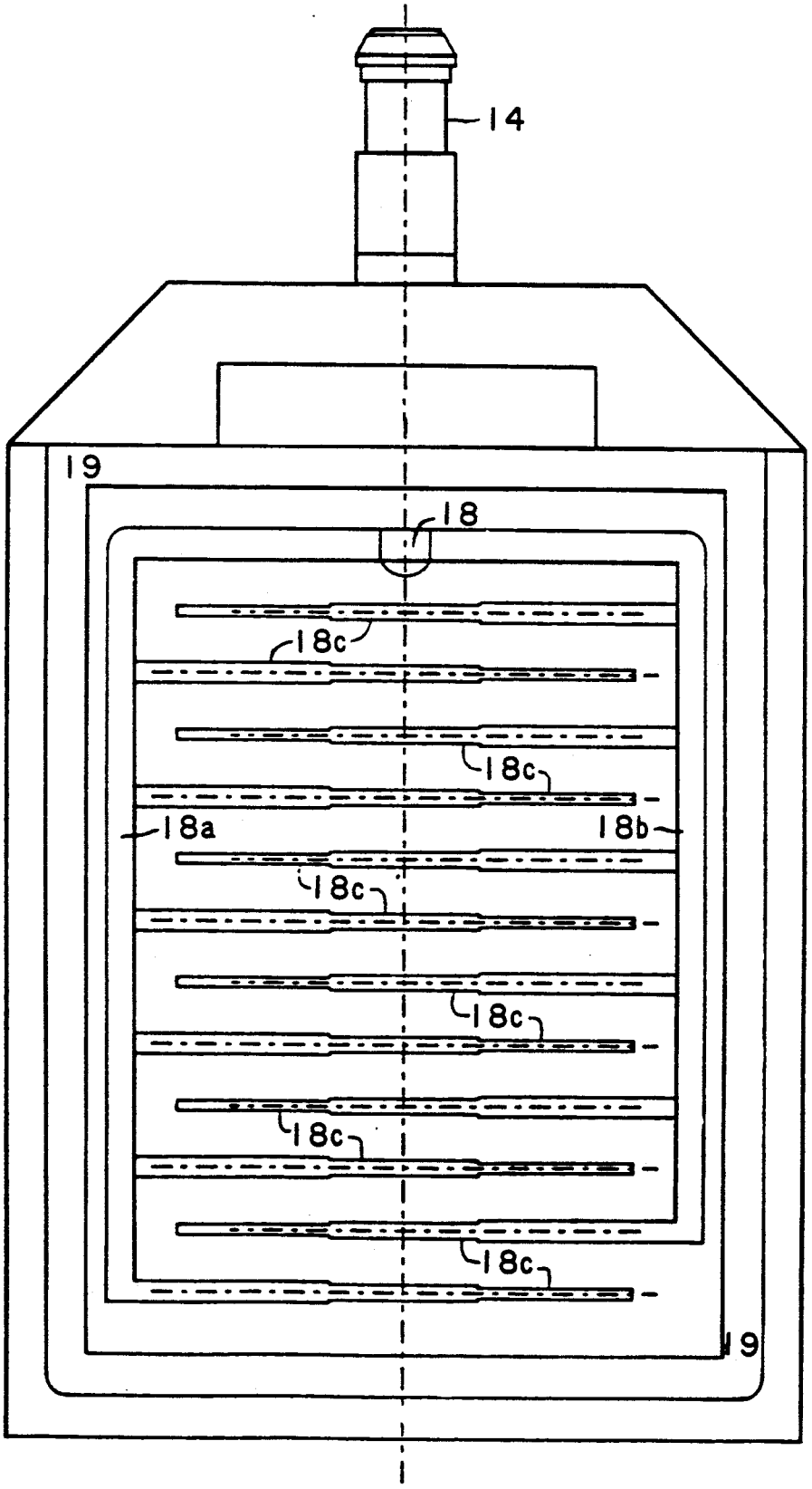
FIG. 10 is a top view of a fluid distribution plate for the embodiment of FIG. 8.

Details of the individual plates are shown in FIGS. 10–15. In FIG. 10, a top view of the distribution plate 10 is shown. Channeling of wash liquid occurs in two directions at once into 11/64-inch (0.172-inch) side distribution channels 18*a* and 18*b*, each of which reach half of the tips in alternate rows. The channels 18*c* that reach the tips are all 0.1 inch in depth and vary in width from ⅛ (0.125) inch at the entry and first three holes, to 3/32 (0.094) inch at the next three holes, and 1/16 (0.063) inch at the last two. By alternating this varying width for each row, the between-channel thickness of the plate is kept uniform under each of the positioning holes, and the rate of flow of the liquid under each of the exit holes is kept relatively uniform. Ideally each channel should be triangular in shape (i.e., reduce in width uniformly with distance from the connecting side channel), but this staggered variation in thickness allows use of a more easily machined template and has adequate flow uniformity within the narrow distribution channels. Gluing channel 19 and entry tube 14 are also visible in FIG. 10.

Figure 11:
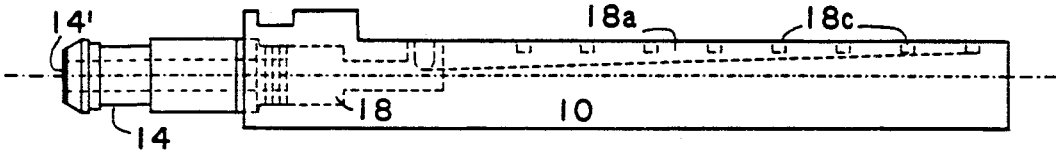
FIG. 11 is a side view of the distribution plate of FIG. 10.

In FIG. 11, a side view of the distribution plate 10 is shown (reduced scale), which reveals a similar system for flow rate control for the side distribution channels. The entry tube 14 (in this embodiment a male hose connector) screws into a face of distribution plate 10 and has a 5/16-inch-diameter (cross-sectional area of 0.077 $in^2$) hole 14' through its center that acts as a fluid entry channel. The entry tube is constructed of Delrin or nylon in the preferred embodiments. The connector screw is ½ inch diameter, 13 threads/inch and is affixed to a silicone rubber gasket with a ⅝ inch diameter, which fits snugly into the inlet port, thereby providing a tight seal on the connection.

The entry tube screws into channel 18, which splits into two channels with the dimensions of 0.1875 inch by 0.275 inch (width by depth; cross-sectional area of 0.052 $in^2$), which may be either rounded or square on the bottom, as channel 18 approaches side channels 18*a* and 18*b*. At the beginning of the side channels, these two channels have a depth of 0.275 inch; at the end, 0.1 inch. One side channel (18*a*) is shown. This tapering prevents artifacts resulting from excessive flow rates and provides a channeling system designed to minimize dead volume and thereby reduce the amount of wash buffer used.

Figure 12:
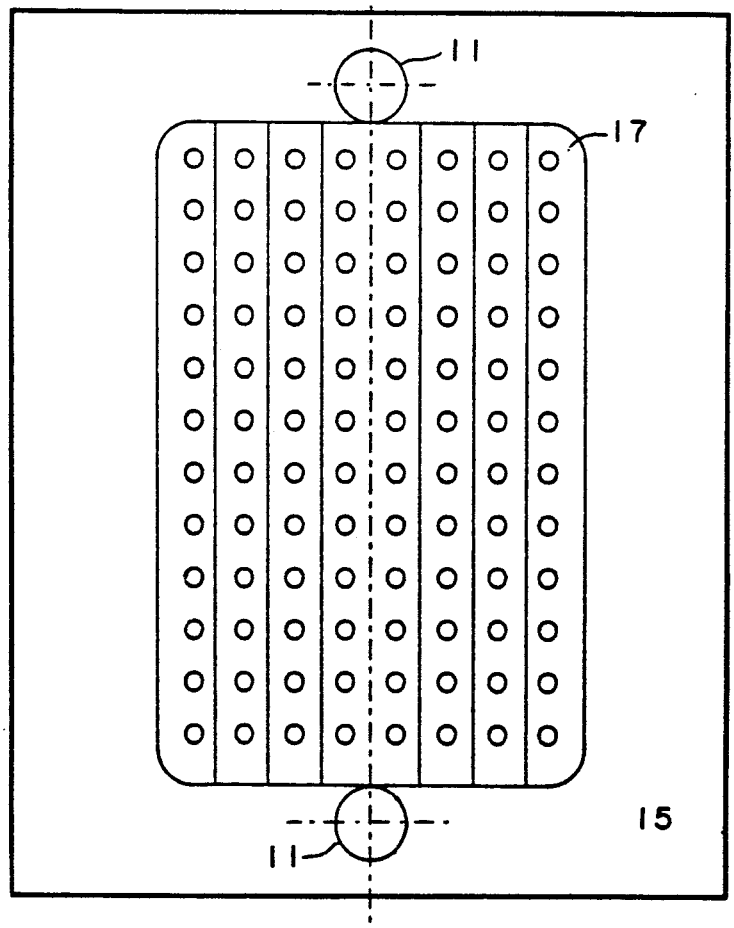
FIG. 12 is a top view of a wash-fluid-aperture plate that is attached to the distribution plate for the embodiment of FIG. 8.

FIG. 12 shows a top view of the support plate 15 containing the fluid distribution holes. All holes are ⅛ (0.125) inch in diameter, and the recess is 3.0 inches wide by 4.5 inches long. The two pegs 11 are located centrally at the edge of the recess. The silicone rubber gasket (not shown) is placed in stepped recess 17, into which it fits snugly.

Figure 13:
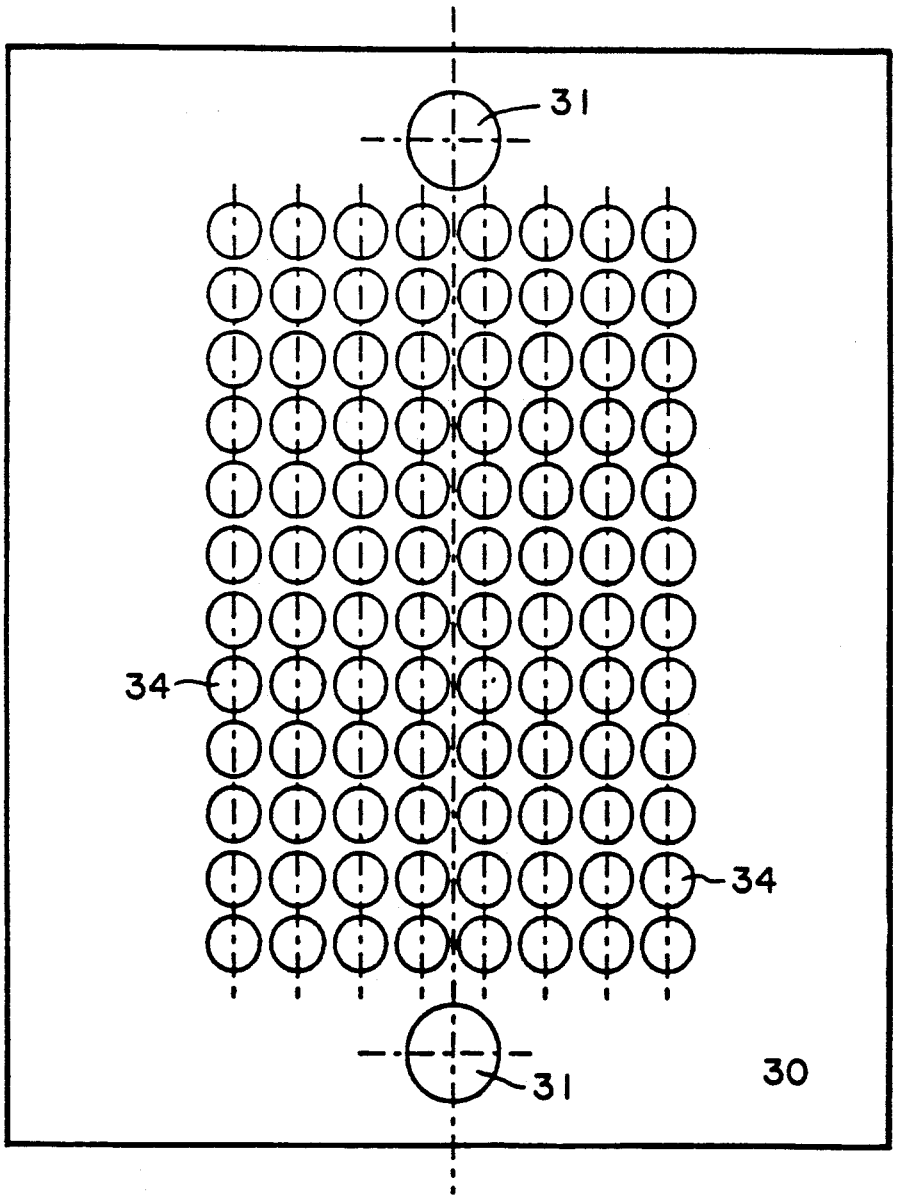
FIG. 13 is a top view of a tip-positioning plate for the embodiment of FIG. 8.

FIG. 13 shows a top view of the tip-positioning plate 30. Holes 34 for disposable tips are 19/64 (0.297) inch in diameter, and the register holes 31 are 17/32 (0.53) inch in diameter.

Figure 14:
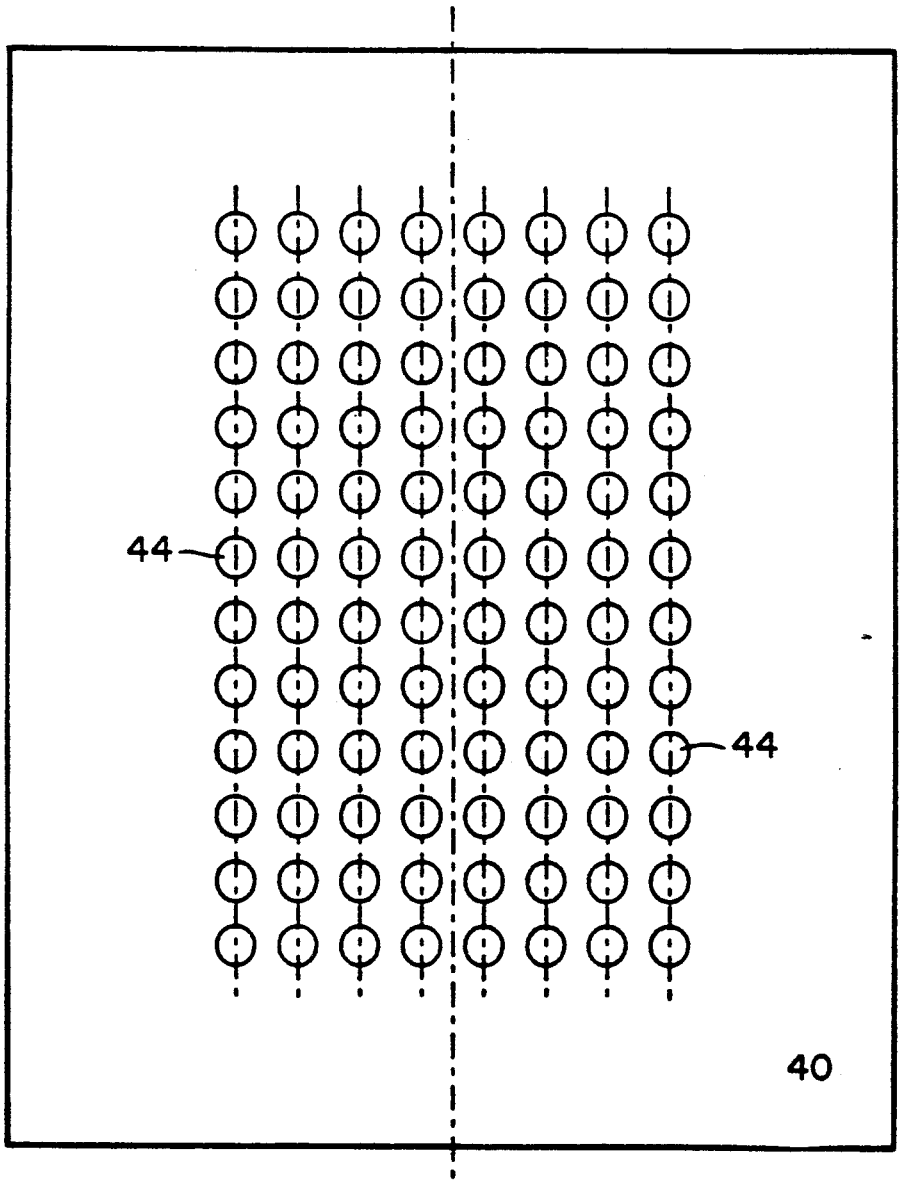
FIG. 14 is a top view of a tip-clamping plate for the embodiment of FIG. 8.

FIG. 14 shows a top view of the tip-clamping plate 40. This plate is made of 10- or 11-gauge stainless steel with 7/32-inch (0.219-inch) holes 44 for engaging the base of the tips. The plate 40 is slightly wider than the plastic plates so that the microtiter-plate-positioning 50 plate can conveniently fit into the U-shaped plate.

Figure 15:
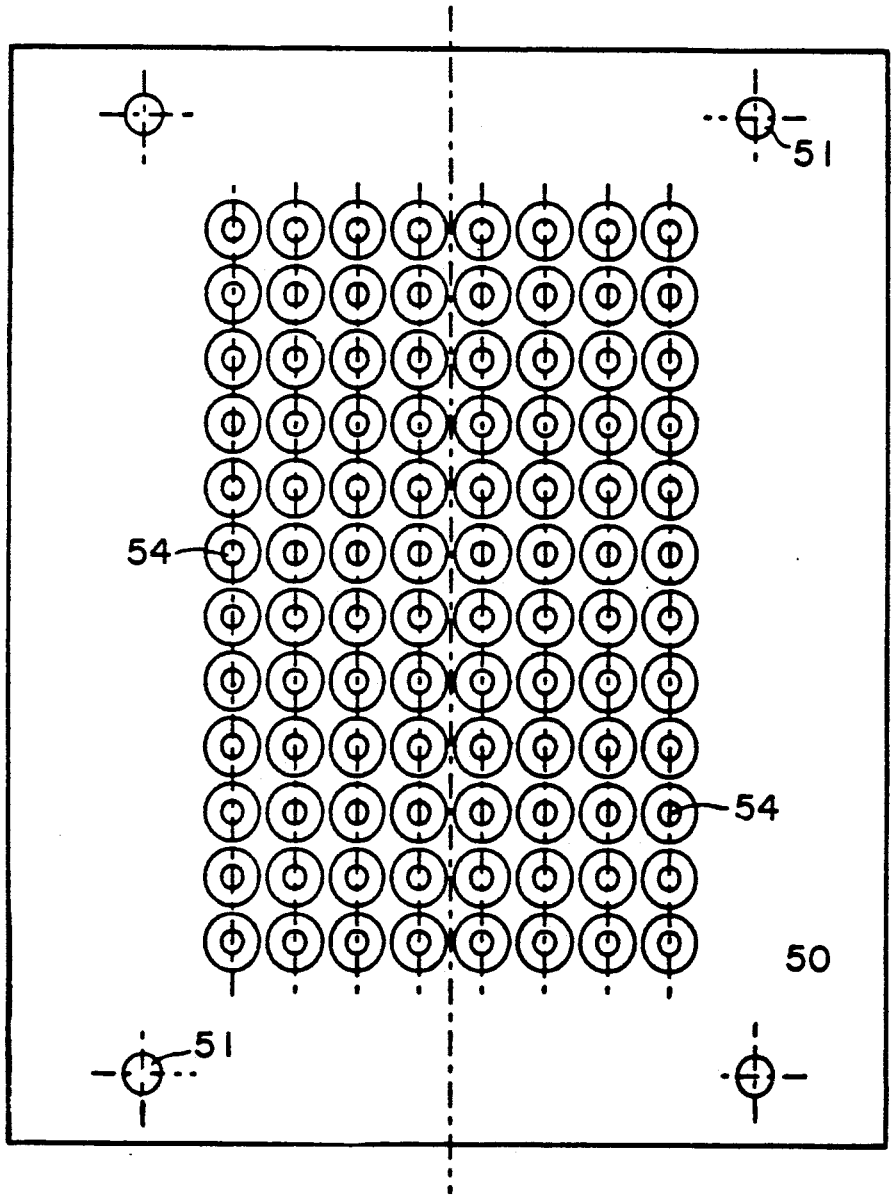
FIG. 15 is a top view of a microtiter-plate-positioning plate for the embodiment of FIG. 8.

FIG. 15 shows a bottom view of the microtiter-plate-postioning plate 50. Threaded ¼-inch (0.25-inch) holes 51 are provided for height adjustment, and the holes 54 for tip localization are ⅛-inch diameter equipped with a 0.1-inch deep, 60° taper so that the tips readily fit into the plate.

All publications mentioned in this specification are indicative of the level of skill of those skilled in the art to which this invention pertains. All publications are herein incorporated by reference to the same extent as if each individual publication was specifically and individually indicated to be incorporated by reference.

The invention now being fully described, it will be apparent to one of ordinary skill in the art that many changes and modifications can be made thereto without departing from the spirit or scope of the appended claims.

What is claimed is:

1. A microtiter plate washer, comprising:

multiple upward-directed nozzles spaced to correspond to an equal number of microtiter plate wells, each nozzle comprising a body member with an internal cavity and an orifice;

means for distributing liquid to the internal cavity of each nozzle; and means for releasably and concurrently urging said nozzles against said distribution means, wherein a base portion of each of said nozzles engages said distribution means to direct flow of liquid from said distribution means through said internal cavities of said nozzles to said nozzle orifices and wherein said urging means comprises a plate having a plurality of holes sized to allow a portion of said nozzle containing said orifice to pass therethrough but further being sized to prevent passage of a base portion of said nozzle.

2. The microtiter plate washer of claim 1, whereby all nozzle orifices in said microtiter plate washer provide a total orifice area and further comprising an external reservoir for wash liquid and a fluid conduit connecting an external reservoir to said distribution means, wherein said conduit has a minimum cross-sectional area larger than said total orifice area.

3. The microtiter plate washer of claim 1, wherein said washer further comprises means for registering a microtiter plate over said nozzles.

4. The microtiter plate washer of claim 1, wherein said plurality of nozzles comprises a collection of individual nozzles.

5. The microtiter plate washer of claim 1, wherein at least two of said multiple upward-directed nozzles are formed from a single body member.

6. The microtiter plate washer of claim 1, wherein said urging means further comprises means for attaching said plate to said distributing means.

7. The microtiter plate washer of claim 1, wherein said holes are sized to allow said nozzles to separate from said plate entirely under force imparted by their own weight when said plate is detached from said distribution means.

8. The microtiter plate washer of claim 1, wherein said distribution means is rotatably attached to said plate along an edge of said distribution means and said plate.

9. The microtiter plate washer of claim 1, wherein said distribution means is further connected to a compressed gas supply means.

10. The microtiter plate washer of claim 1, further comprising means for sealing said nozzle to said distribution means.

11. The microtiter plate washer of claim 10, wherein said sealing means comprises a resilient member attached to or forming part of said distribution means or said nozzle base.

12. The microtiter plate washer of claim 1, wherein said nozzle comprises a disposable automatic-pipette tip.

13. A microtiter plate washer for washing a multiple number of wells of a microtiter plate using disposable fluid-directing nozzles, comprising;

a fluid distributing member comprising a fluid inlet and a multiple of fluid outlets in a spaced array matching all or part of the wells of said microtiter plate;

a clamping plate having said multiple of holes spaced in said array, wherein said holes are sized to allow part of said nozzles to pass freely therethrough while preventing passage of a base portion of said nozzles; and means for clamping said plate to said fluid distribution member whereby said base portions of said nozzles inserted in said holes of said clamping plate are urged against said fluid distributing member at the location of said fluid outlets.

14. The microtiter plate washer of claim 13, further comprising means for registering wells of an inverted microtiter plate over nozzles located in said hole of said clamping plate.

* * * * *